US008973321B2

(12) United States Patent
Pelosi

(10) Patent No.: US 8,973,321 B2
(45) Date of Patent: Mar. 10, 2015

(54) TWO-PART MOLDING SYSTEM

(71) Applicant: Tarkett USA Inc., Chagrin Falls, OH (US)

(72) Inventor: Frank Pelosi, Cherry Hill, NJ (US)

( * ) Notice: Subject to any disclaimer, the term of this patent is extended or adjusted under 35 U.S.C. 154(b) by 0 days.

(21) Appl. No.: 14/209,080

(22) Filed: Mar. 13, 2014

(65) Prior Publication Data

US 2014/0260021 A1 Sep. 18, 2014

Related U.S. Application Data

(60) Provisional application No. 61/798,302, filed on Mar. 15, 2013.

(51) Int. Cl.

| | |
|---|---|
| ***E04F 19/04*** | (2006.01) |
| ***E04F 13/073*** | (2006.01) |
| ***E04F 13/21*** | (2006.01) |
| ***E04F 19/02*** | (2006.01) |

(52) U.S. Cl.

CPC ..... *E04F 13/0733* (2013.01); *E04F 13/21* (2013.01); *E04F 19/02* (2013.01)

USPC ..... 52/287.1; 52/290; 52/312; 52/716.1

(58) Field of Classification Search

CPC . E04F 19/045; E04F 19/0477; E04F 19/0463; E04F 19/0481

USPC ..... 52/718.01, 718.04, 287.1, 288.1, 290, 52/312, 716.1

See application file for complete search history.

(56) References Cited

U.S. PATENT DOCUMENTS

| | | | | |
|---|---|---|---|---|
| 1,936,507 | A | 11/1933 | Green | |
| 1,963,662 | A | 6/1934 | Knapp | |
| 2,203,119 | A | 6/1940 | Wollaeger | |
| 2,316,980 | A | 4/1943 | Sigloch et al. | |
| 2,478,006 | A | 8/1949 | Paden | |
| 3,201,909 | A | 8/1965 | Grun | |
| 3,228,160 | A | 1/1966 | O'Brien | |
| 3,286,422 | A | 11/1966 | Pangerl | |
| 3,422,584 | A | 1/1969 | Howard | |
| 3,448,552 | A | 6/1969 | Schmitt et al. | |
| 3,449,873 | A | 6/1969 | Damato et al. | |
| 3,464,177 | A | 9/1969 | Amato | |
| 3,707,061 | A | 12/1972 | Collette et al. | |
| 3,911,637 | A | 10/1975 | Schmidiger | |
| 4,008,549 | A * | 2/1977 | Dobija | 52/287.1 |

(Continued)

FOREIGN PATENT DOCUMENTS

| | | |
|---|---|---|
| CA | 835019 | 2/1970 |
| CH | 362512 | 7/1962 |

(Continued)

*Primary Examiner* — Robert Canfield

(57) ABSTRACT

A two-part molding system for use in connection with a floor and wall. The two-part molding system comprises a mounting portion having a back surface, a front surface, a top side and a bottom side. A projection or abutment is provided on the front surface of the mounting portion which has an underside for defining a receiving area. A molding portion is provided which has a back surface, a front surface, a top side, a bottom side and a toe. The top side defines a surface for engaging with and corresponding with the receiving area of said underside of the projection or abutment. The molding portion engages with the mounting portion to create a compression engagement between the molding portion and the floor.

24 Claims, 5 Drawing Sheets

(56) References Cited

U.S. PATENT DOCUMENTS

| | | | | | |
|---|---|---|---|---|---|
| 4,037,900 | A | | 7/1977 | Schmidger | |
| 4,052,830 | A | * | 10/1977 | Smith | 52/288.1 |
| 4,204,376 | A | | 5/1980 | Calvert | |
| 4,461,135 | A | | 7/1984 | Anderson et al. | |
| 4,565,041 | A | | 1/1986 | Wendt | |
| 4,569,171 | A | | 2/1986 | Kuhr et al. | |
| 4,800,699 | A | | 1/1989 | Lang | |
| 4,986,332 | A | | 1/1991 | Lanuza | |
| 5,010,703 | A | * | 4/1991 | Pearlman et al. | 52/287.1 |
| 5,243,800 | A | | 9/1993 | Olbrich | |
| 5,274,972 | A | | 1/1994 | Hansen | |
| 5,444,954 | A | * | 8/1995 | Anderson | 52/288.1 |
| 5,553,431 | A | | 9/1996 | Pelosi, Jr. et al. | |
| 5,598,681 | A | * | 2/1997 | DiGianni | 52/717.05 |
| 5,694,726 | A | | 12/1997 | Wu | |
| 5,752,356 | A | | 5/1998 | Miklavic et al. | |
| 6,122,872 | A | | 9/2000 | Sauter | |
| 6,189,275 | B1 | | 2/2001 | Schlisner | |
| 6,324,799 | B1 | * | 12/2001 | Salvitti | 52/287.1 |
| 6,354,049 | B1 | | 3/2002 | Bennett | |
| 6,545,214 | B2 | | 4/2003 | Russell et al. | |
| 6,584,743 | B2 | | 7/2003 | Paxton et al. | |
| 6,643,987 | B2 | | 11/2003 | Rusch et al. | |
| D484,253 | S | | 12/2003 | Glatz | |
| 6,729,087 | B2 | | 5/2004 | Sauter | |
| 7,047,702 | B1 | | 5/2006 | Callens et al. | |
| D579,123 | S | | 10/2008 | Johnston | |
| D579,124 | S | | 10/2008 | Sauter et al. | |
| 7,451,574 | B2 | | 11/2008 | Spek | |
| 7,574,836 | B2 | | 8/2009 | Wesolowska | |
| 7,594,368 | B2 | | 9/2009 | Kurz | |
| 7,703,249 | B2 | | 4/2010 | Rachak | |
| D623,770 | S | | 9/2010 | Johnston | |
| D629,125 | S | | 12/2010 | Johnston | |
| 7,914,878 | B2 | | 3/2011 | Carnes et al. | |
| 8,122,658 | B2 | | 2/2012 | Sondermann | |
| 8,171,698 | B2 | * | 5/2012 | Neuhofer jun. | 52/718.06 |
| 8,375,663 | B2 | | 2/2013 | Johnston et al. | |
| 2010/0186329 | A1 | * | 7/2010 | Buys | 52/288.1 |
| 2011/0192101 | A1 | | 8/2011 | Johnston et al. | |

FOREIGN PATENT DOCUMENTS

| | | | | | |
|---|---|---|---|---|---|
| EP | 1202418 | A2 | | 5/2002 | |
| EP | 1580347 | | | 9/2005 | |
| FR | 1317930 | | | 1/1962 | |
| GB | 1032103 | | | 6/1966 | |
| GB | 1144551 | | | 3/1969 | |
| JP | 05263517 | A | * | 10/1993 | E04F 19/04 |
| WO | WO 00/61890 | | | 10/2000 | |
| WO | WO 03/002319 | A1 | | 1/2003 | |

* cited by examiner

TWO-PART MOLDING SYSTEM

CROSS-REFERENCE TO RELATED APPLICATION

This application claims the benefit of U.S. Provisional Application No. 61/798,302 filed on Mar. 15, 2013, the entirety of which is incorporated herein by reference.

BACKGROUND OF THE INVENTION

1. Field of the Invention

The present invention relates generally to a two-part molding system. The present invention more specifically relates to a two-part molding system for providing a compression mount with the floor at the base of a wall, and methods for making and installing such a two-part molding system.

2. Description of Prior Art

Baseboards and wall bases are known in the art as molding or trim applied at the base of a wall to complete the junction between the wall and the floor. These wall bases serve to decorate, as well as to protect, the wall from scuffing and impact from feet, machines such as vacuum cleaners, wheelchairs, dollies, wheeled furniture, etc. Furthermore, the wall bases protect the edge of the carpet or flooring adjacent to the wall. Moldings are also used to hide various imperfections and inconsistencies in a wall finish, such as where walls are not finished all the way to the floor, low spots, wall openings and the like.

Wall base moldings are commonly used where a wall meets a floor to provide a neat and acceptable appearance at the wall-floor juncture. Moldings are made from a variety of materials, using a variety of methods as would be understood by those skilled in the art. For example, moldings are commonly made from a polymeric material such as polyvinyl chloride (PVC) that is extruded via conventional extrusion or injection molding processes known in the art. Extruded PVC is typically a cost-effective building material that can be provided in a variety of colors and decorative styles.

Referring to FIGS. 1-4, prior art wall base moldings are shown. As demonstrated in FIGS. 1-4, prior art wall base moldings are commonly used in a variety of settings, including environments which are considered "sanitary-sensitive" environments such as in hospitals and nursing homes. One particular ongoing issue that exists in hospitals and nursing homes, for example, is secondary infection to patients and personnel. As shown in FIGS. 1-4, damaged wall base moldings 1 can include a toe base 2 that does not sufficiently fit or conform evenly to the underlying floor. Over time, damage at the toe base 2 of conventional prior art wall base moldings 1 can worsen due to normal wear-and-tear, or can be exacerbated from floor buffers, hospital carts, wheel chairs, normal shrinkage and hospital machines and equipment. In turn, undesirable elements such as dirty water from washing/cleaning the floor, dirt, moisture, and even bodily fluids can accumulate under the damaged toe base 2.

One prior art method for addressing the issue of cleanliness is the use of a molding base that is integral with the floor. However, this type of system can be disadvantageous in certain settings of use due to the relative high cost of installation and manufacture. Moreover, a molding base that is integral with the floor is expensive to replace since the entire integral molding base and floor would typically have to be replaced.

Another issue that exists in hospitals and nursing homes, for example, is the relative poor aesthetic appearance of traditional wall bases and cove bases. It is well known that it is desirable for health care facilities including hospitals and nursing homes to advantageously employ aesthetically-appealing environments to improve the morale and psychological state of the patients. However, aesthetically-appealing building materials are typically inherently more expensive. Due to the inevitable high risk of damage to the wall base and cove base in hospitals and nursing homes, in turn requiring more frequent repair and/or replacement, such facilities typically use lower end materials which have a relatively poor appearance. As discussed in greater detail below, the present invention addresses this issue by allowing the use of a more durable and more aesthetically-pleasing wall base in combination with a removable and relatively less expensive molding piece.

One known type of removable molding includes a mechanical hook and loop fastening system, such as VELCRO® brand strips for mounting a molding to an adjacent wall. In this type of arrangement, one of the portions or strips of the fastening system is affixed to the wall and the other is affixed to the molding. The molding is then mounted to the wall by joining the fastening strips to one another. Such fastening systems tend to be disadvantageous since the connection between the respective hook and loop mounting strips tends to weaken over time, thereby decreasing an effective mounting between the molding and the adjacent wall.

Another known type of removable two-part base molding system including a mounting portion and a molding portion which can be affixed to one another by overlapping corresponding edges, such as that shown in U.S. Pat. No. 6,729,087 (Sauter). Such systems can be disadvantageous since the connection between the mounting portion and a molding portion in such systems tends to not be firm against the underlying floor such that even very small gaps can remain between the molding and the underlying floor.

There is therefore a need for a molding system that can be removable that also facilitates ease of installation, repair, maintenance and replacement. Such a system should further promote a sanitary environment. Moreover, such a system should be easy and cost effective to manufacture, to ship, install, maintain and replace. The present invention fills the need for such a molding system.

SUMMARY OF THE INVENTION

A two-part molding system for mounting, for example a wall base, to a wall adjacent to a floor includes a mounting portion (or a backing portion) and a removable, mechanically fastened and installed molding portion. The molding portion can be removed for replacement, repair or for change in aesthetics.

The mounting portion defines a main body having a front face and a projection or abutment, such as a notch, flange, lip or ledge for defining a groove, recess or abutment surface, integrally formed with the mounting portion, or any other comparable surface, including an overhanging surface which would be conventional in the art. Alternatively, the projection or abutment can be mechanically fastened to the mounting portion after manufacture of the individual components. The projection or abutment is located at a desired location on the front face of the mounting portion at a particular predetermined height above the floor level. The projection or abutment includes a receiving section or abutment surface which defines the groove, recess or ledge for receiving a corresponding engaging section of the molding portion.

The molding portion is removably mounted to the mounting portion. The molding portion defines a main body having a top end defining an engaging section for engaging the corresponding receiving section of the overlying or overhanging projection or abutment. It should of course be appreciated that, alternatively, the notch can comprise the engaging section while the top end of the molding portion defines a receiving section.

The respective receiving section and engagement section are configured to correspond to, and securely engage with one another regardless of the particular desired configurations. In an embodiment of the present invention, the receiving section of the notch is angled substantially inwardly at about 0°-90°, or even at about, 30°-60°, or even further at about 40°-50°, and still further at about 45°, while the engaging section of the molding portion is angled substantially outwardly in a corresponding manner at about 0°-90°, or even at about, 30°-60°, or even further at about 40°-50°, and still further at about 45°. It should of course be understood, as indicated above, that the underside of the projection or abutment may be angled substantially outwardly at a defined angle (in this case the engaging section), while the respective counterpart portion of the molding portion may be angled substantially inwardly at a corresponding defined angle (in this case the receiving section). It should also be understood that the projection or abutment can be squared or flat (i.e. 90° relative to the vertical surface of the mounting portion) in which case the corresponding molding portion comprises a substantially corresponding abutment surface for engaging with the projection or abutment, or may alternatively be arced, rounded, triangular or any other conventional configuration known in the art.

The molding portion can be advantageously mounted to the mounting portion to define a space or gap between the molding portion and the mounting portion mounted against the wall. This space can advantageously and optionally be employed to accommodate additional adhesion materials and/or filling agents, such as a caulking agent. Preferably, an anti-microbial caulk or anti-bacterial caulk may be employed to further improve and enhance the sanitary environment.

An object of this invention is to provide a two-part molding system which can be manufactured relatively quickly and easily.

A further object of this invention is to provide a two-part molding system which can be installed, maintained and replaced at the base of a wall relatively quickly and easily.

Another object of this invention is to provide a two-part molding system which can be manufactured, installed, replaced and maintained at the base of a wall in a cost-effective manner.

Another object of this invention is to provide a two-part molding system which provides an improved sanitary environment.

Yet another object of this invention is to provide a two-part molding system which provides an improved aesthetic appearance.

Still yet another object of this invention is to provide a two-part molding system which is relatively inexpensive to manufacture.

An additional object of this invention is to provide a two-part molding system which can be employed within sanitary environments, such as hospitals, nursing homes and the like.

It is an additional object of this invention to provide a two-part molding system which provides an improved flush juncture between the floor and the base of the wall.

Still yet another object of this invention is to create an improved juncture at the base of a wall relative to the adjacent floor.

Yet another object of the present invention is to provide a two-part molding system which can advantageously be installed around inside corners and outside corners of walls.

These and other objects will become apparent from the following description of a preferred embodiment taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENTS

Figure 1:
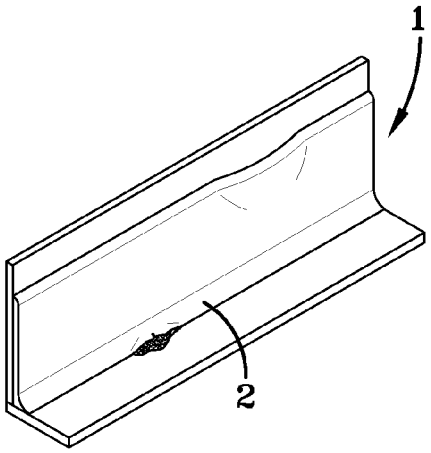
FIG-1 PRIOR ART
FIGS. 1-4 are perspective views of prior art molding systems.
Figure 2:
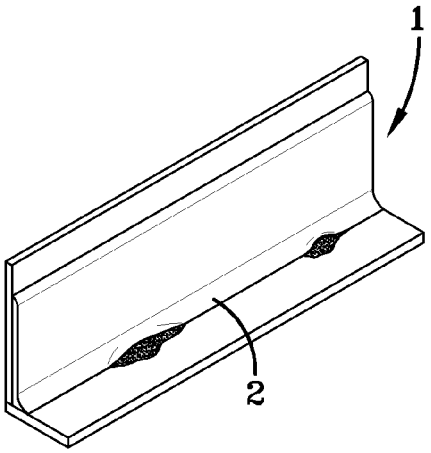
FIG-2 PRIOR ART
Figure 3:
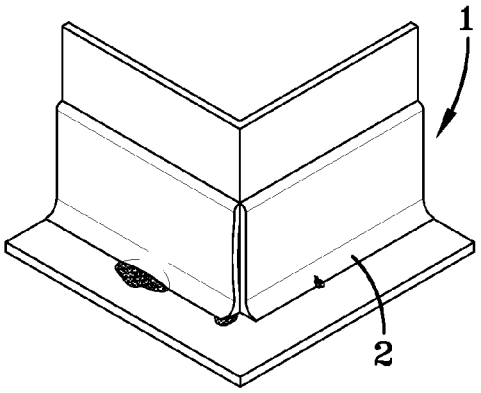
FIG-3 PRIOR ART
Figure 4:
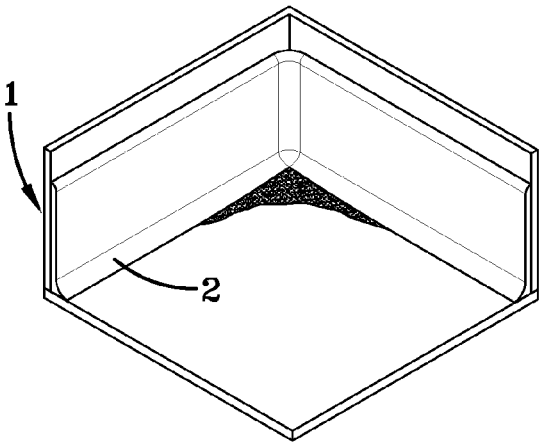
FIG-4 PRIOR ART

It should be understood that the present invention may include embodiments in various forms. However, there is shown in the drawings and hereinafter described various particular embodiments for the present invention. It should be understood that the present invention is not limited to the embodiments described herein.

Figure 5A:
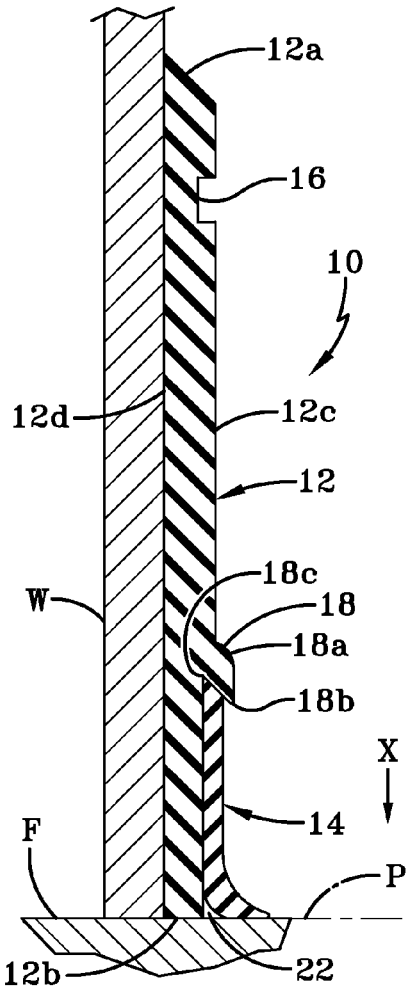
FIG. 5A is a cross-sectional view of one embodiment of the two-part molding system according to the present invention.

Referring to the drawings, which are used for illustration and not to limit the invention therewith, FIG. 5A shows a cross-sectional view of a two-part, separable molding system 10 according to an embodiment of the present invention. As shown in FIG. 5A, two-part molding system 10 is generally a two-part flooring system comprising a wall mounting portion 12 and a molding portion 14. The wall mounting portion, such as for example, a wall base, may be permanently or semi-permanently installed against an adjacent wall ("W") to which the two-part, separable molding system 10 is secured. As explained below, molding portion 14 may be an insert portion that can be manually engaged with mounting portion 12 by appropriate mechanisms. The molding portion 14 can be easily and readily mounted to the mounting portion 12 and can be easily removed from the mounting portion 12 as required and desired.

Mounting portion 12 is a relatively rigid structural component as conventional in the art that can be mounted to the wall W using any number of methods conventional in the art, such as glue, adhesives, screws and the like.

Mounting portion 12 may be any conventional construction material employed in the art employed at the base of a wall having functional and/or aesthetic purposes, such as but not limited to wall bases, trim, molding, and the like and may comprise any material conventional in the art, such as but not limited to flexible plastic, thermoplastic, vinyl, PVC, rubber, wood, faux wood and the like. Mounting portion 12 may be manufactured by methods conventional in the art such as but not limited to extrusion or injection molding methods. As shown in FIG. 5A, mounting portion 12 may be a wall base such as that shown and described in U.S. Design Pat. No. D484,253 incorporated by reference herewith in its entirety. For purposes of explanation, mounting portion 12 may be referred to hereinafter as wall base 12. However, it should be appreciated that the wall base shown in FIG. 5A is shown and described for purposes of describing one embodiment of the present invention, and the flooring system according to the present invention is not limited to employment with a wall base.

Figure 5B:
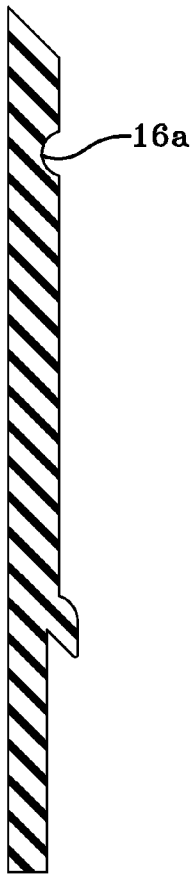
FIG. 5B is a side view of another embodiment of the mounting portion of the two-part molding system according to the present invention.

As shown in FIG. 5A, mounting portion or wall base 12 comprises a top surface 12*a*, a bottom surface 12*b*, a front face 12*c* and a back side 12*d*. Top surface 12*a* may comprise, for example, an angled surface as shown in FIG. 5A for aesthetic purposes but is not limited to such a configuration. Top surface 12*a* may be substantially flat, curved, angled or have any other desired decorative configuration as commonly employed in the art. Bottom surface 12*b* is preferably a substantially flat surface for placement against the underlying floor ("F") and intimately engages the underlying floor ("F"). Back side 12*d* is a substantially flat surface or substantially ribbed surface for placement against the adjacent supporting wall W as known in the art. Front face 12*c* is preferably a substantially flat surface, but may further include decorative portions such as a decorative groove 16. It should be understood that decorative groove 16 is provided for aesthetic purposes, and may comprise any configuration as conventional in the art such as squared, rounded, curved inwardly, curved outwardly, and the like. It should also be understood that multiple decorative grooves 16 may be provided for aesthetic purposes, and may comprise any one or more configurations as conventional in the art such as squared, rounded, curved inwardly, curved outwardly, and the like. For example, as shown in FIG. 5A groove 16 can be a decorative groove having a squared or rectangular cross-section. Alternatively, for example, as shown in FIG. 5B groove 16A can be a decorative groove having an arced or circular cross-section.

Still referring to FIG. 5A, front face 12*c* comprises an overhanging projection or abutment, such as a notch, flange, or lip 18 for defining a receiving area, such as a recess, groove, ledge or abutment surface, for receiving and securing molding portion 14 in place. It should be appreciated that the overhanging portion of the projection 18 can be omitted such that the projection 18 would be substantially flat or squared for defining a ledge rather than a groove or recess. As discussed herein, overhanging projection or abutment structure 18 will be referred to as a notch. It should of course be appreciated that the presently claimed invention need not be limited to a notch per se, and any other comparable overhanging projection or abutment surface which would be conventional in the art may be advantageously employed in accordance with the present invention.

As shown in FIG. 5A, notch 18 is a substantially outwardly and downwardly extending notch 18 relative to front face 12*c* of wall base 12 (i.e., an overhanging projection or abutment), and comprises a contoured surface, such as a curved surface 18*a*, an angled tip 18*b* and a receiving female end 18*c*. It should be understood that notch 18 may comprise any desirable or appropriate configuration so long as notch 18 sufficiently engages with and secures molding portion 14 at receiving female end 18*c*, including but not limited to angled, squared, curved and the like. As shown in FIG. 5A, angled receiving end 18*c* and angled tip 18*b* define an angled surface therebetween. As shown in FIG. 5A, receiving female end 18*c* comprises an inwardly angle of about between 40°-50°, but can be angled inwardly at about 0°-90°, or even at about 30°-60°, or even further preferably at about 45°, for engaging with and securing molding portion 14 having a corresponding angled end or substantially corresponding angled end (described further below). It should be understood that receiving female end 18*c* is not limited to an inwardly angled receiving end but rather may comprise any alternative configuration such as but not limited to outwardly angled, curved, squared, triangular and the like, or any combination thereof.

Figure 6C:
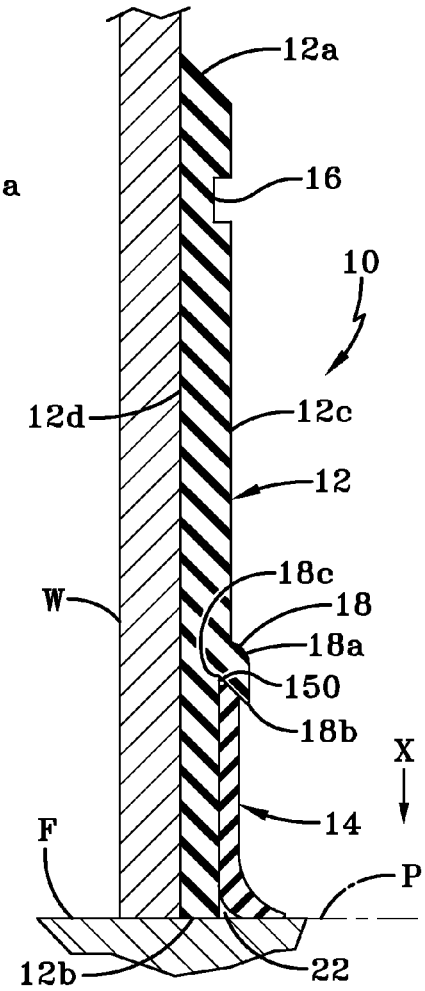
FIG. 6C is a cross-sectional view of another embodiment of the two-part molding system according to the present invention.
Figure 6:
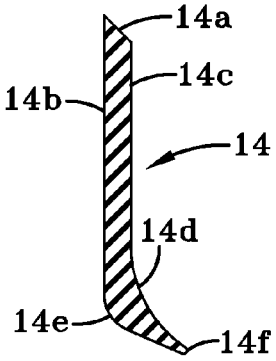
FIG. 6 is a side view of a molding portion of the two-part molding system according to the present invention, as shown in FIG. 5A.

Still referring to FIG. 5A as well as FIG. 6, two-part molding system 10 further comprises molding portion 14. Molding portion 14 may be any conventional construction device employed in the art, such as but not limited to trim, a molding, flooring toe and the like and may comprise any material conventional in the art, such as but not limited to flexible plastic, thermoplastic, vinyl, rubber, wood, PVC, faux wood and the like. Molding portion 14 may be manufactured by methods conventional in the art such as but not limited to extrusion or injection molding methods. As shown in FIG. 5A, molding portion 14 may be a flooring toe that is manually secured to mounting portion 12 by mechanical adhering products known in the art such as but not limited to caulk, adhesives, two-sided tape and the like. However, it should be appreciated that the molding portion or toe 14 shown in FIG. 5A and FIG. 6 is shown and described for purposes of describing one embodiment of the present invention, and the flooring system according to the present invention is not limited to employment with a flooring toe. In accordance with the present invention, molding portion 14 may comprise the same material or a different material as that of mounting portion 12.

As shown in FIG. 5A and FIG. 6, molding portion 14, in one embodiment, comprises a top surface 14*a*, a front face 14*c*, a front curved surface 14*d*, a rear curved surface 14*e*, a back side 14*b* and a toe 14*f*. Top surface 14*a* may comprise, for example, an outwardly/upwardly angled surface as shown in FIG. 5A for sufficiently engaging with and securing into receiving female end 18*c* of notch 18. As shown in FIG. 5A, top surface 14*a* comprises an outward angle of about between 40°-50°, but can be angled outwardly at about 0°-90°, or even at about 30°-60°, or even further preferably at about 45°, for engagement with and securing into female receiving end 18*c* of notch 18. It should be understood that the particular configuration and/or angle of top edge 14*a* is determined by being a corresponding, or substantially corresponding, surface configuration and/or angle to that of female receiving end 18*c* and angled tip 18*b* of notch 18 which define an angled surface therebetween. In other words, the top edge 14*a* of the molding portion may also comprise any alternative configuration as conventional in the art such as inwardly angled, curved, rounded, squared, triangular and the like.

Figure 6A:
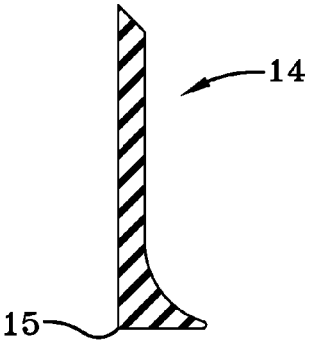
FIG. 6A is a side view of an alternative embodiment of the molding portion of the two-part molding system according to the present invention, as shown in FIG. 5A.

Alternatively, it should be appreciated that back side 14*b* of molding portion 14 may abut both the adjacent mounting portion 12 and underlying floor F at respective right angles 15 (FIG. 6A).

Figure 6B:
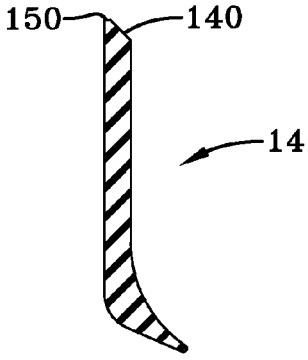
FIG. 6B is a side view of another alternative embodiment of the molding portion of the two-part molding system according to the present invention, as shown in FIG. 5A.
Figure 7:
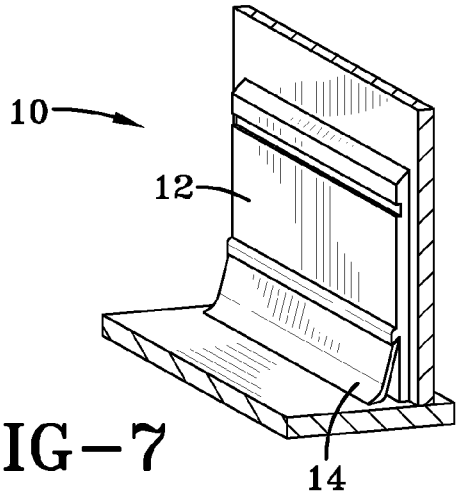
FIGS. 7-10 are perspective views of one embodiment of the two-part molding system according to the present invention, as shown in FIG. 5A.
Figure 8:
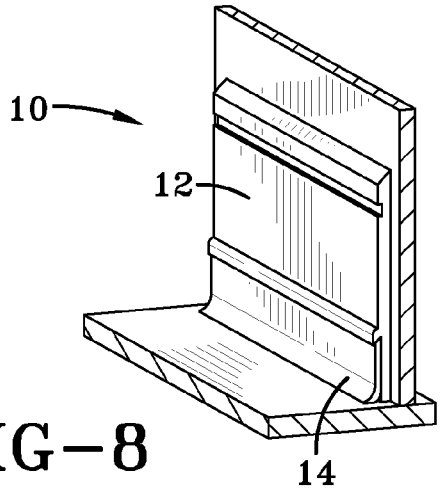
Figure 9:
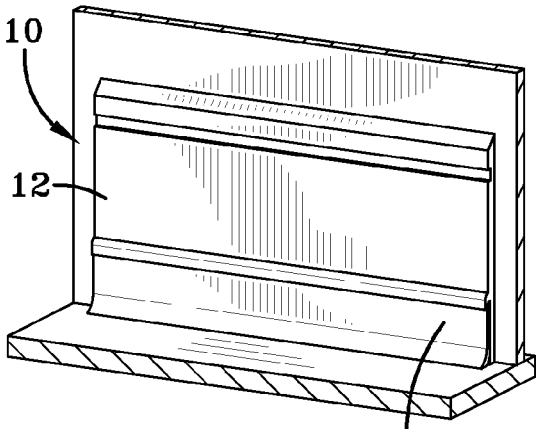
Figure 10:
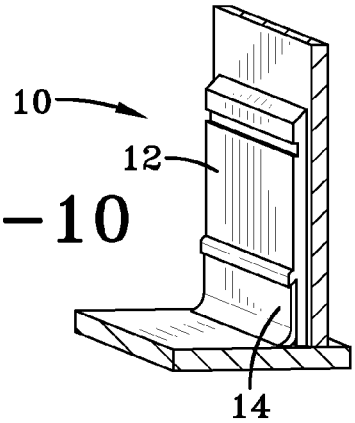

As shown at FIG. 6B, it should be appreciated that the top surface of the molding portion 14, shown at reference number 140 in FIG. 6B, may comprise an upwardly angled surface extending to a substantially flat top side or flat tip 150 for engaging with the substantially corresponding angled surface of the mounting portion at notch 18. It should be appreciated, for example, that flat top section or flat tip 150 can advantageously facilitate a sufficient engagement between the angled top surface 140 and the opposing corresponding angled face of notch 18 at the notch receiving end 18*c*. As shown in FIG. 6B, the width of flat tip 150 is less than ½ the thickness of molding portion 14 as measured between back side 14*b* and front face 14*c*.

As shown at FIG. 6C, an alternative embodiment of the two-part molding system according to the present invention is shown and described. As shown therein, mounting portion 12 remains the same as described above and as shown in FIG. 5A. However, molding portion 14 is employed as described above and as shown in FIG. 6B. As shown therein, molding portion 14 comprises upwardly angled surface 140 extending to substantially flat top side or flat tip 150 for engaging with a substantially corresponding female surface of the mounting portion at angled notch underside 18*c*. It should be appreciated, for example, that flat top section or flat tip 150 can advantageously facilitate a sufficient engagement between angled top surface 140 and the opposing corresponding angled face of the notch at the notch underside 18*c* to sufficiently affect a downwardly compression mount in accordance with the present invention.

Back side 14*b* is preferably a substantially flat surface for direct placement against and for abutting against the portion of front face 12*c* of wall base 12 directly underneath notch 18. Molding portion 14 may be secured to mounting portion 12 by mechanical adhering products known in the art such as but not limited to glue, adhesives, two-sided tape and the like. Front face 14*c* is preferably a substantially flat surface extending downwardly from underneath notch 18. Substantially flat back side 14*b* extends downwardly into rear curved surface 14*e* while substantially flat front face 14*c* extends downwardly into front curved surface 14*d*. Opposing front curved surface 14*d* and rear curved surface 14*e* extend outwardly relative to wall base 12 and merge to define toe 14*f*. Toe 14*f* is an extending toe which tapers in thickness from the body of molding portion 14 to substantially the level of the floor, such as for example tapers from about 0.125 inches to about 0.080 inches or less to be substantially flush with the level of the floor. It should be appreciated that the instant description of molding portion 14 is for exemplary purposes only and the present invention is not limited to a molding portion 14 as described as such.

As shown in FIG. 5A, notch 18 is integrally formed with wall base 12, such as by conventional extrusion or injection molding methods, but may alternatively be secured to wall base 12 via conventional adhering products such as by an adhesive. Notch 18 is configured at any desired distance on wall base 12 front face 12*c* above the floor F, such as from about 1-3 inches above the underlying floor F. According to the present invention, molding portion 14 comprises a height that is generally comparable and equivalent to the distance of notch 18 from floor F. For example, notch 18 can be about 1¼ inches from the floor F as measured as the approximate distance from receiving female end 18*c* to the floor F. The corresponding molding portion 14 therefore comprises an approximately equivalent height as measured from the engagement between angled top surface 14*a* and receiving female end 18*c* to the horizontal plane of toe 14*f* ("P" in FIG. 5A). In other words, the height of molding portion 14 should be such that when secured into place against wall base 12, a compression mount is facilitated between toe 14*f* and the underlying floor F in a flush arrangement. Alternatively, molding portion 14 may advantageously comprise a height approximately about 0-25% greater than the height of notch 18 as measured from female receiving end 18*c* to the floor F, and preferably approximately about 0-10% greater than the height of notch 18 as measured from female receiving end 18*c* to the floor F.

In accordance with the present invention, as shown in FIG. 5A, the front face 12*c* of mounting portion 12 and the front face 14*c* of molding portion 14 are substantially planar with each other in a vertical orientation when molding portion 14 is secure in place relative to mounting portion 12. It should be appreciated, however, that the present invention is not necessarily limited to a configuration in which the front face 12*c* of mounting portion 12 and the front face 14*c* of molding portion 14 are substantially planar with each other in a vertical orientation when molding portion 14 is secure in place relative to mounting portion 12.

In accordance with the present invention, as shown in FIG. 5A, molding portion 14 comprises a thickness at top surface 14*a* as conventional in the art for easily applying and securing molding portion 14 to mounting portion 12. As shown in FIG. 5A, the thickness of molding portion 14 at top surface 14*a* can be such to define an overhang of notch 18 relative to where molding portion 14 engages notch 18. It should of course be appreciated that the thickness of molding portion 14 at top surface 14*a* can be such that there is no overhang of notch 18 relative to where molding portion 14 engages notch 18. In other words, according to the present invention, the thickness of molding portion 14 at top surface 14*a* as defined from back side 14*b* to front face 14*c* may be between about 50-100% of the thickness of notch 18 (i.e., the overhanging projection or abutment, such as a notch, flange, or lip 18 for defining a receiving area, such as a recess, groove, lip or abutment surface, for receiving and securing the molding portion 14). It should also be appreciated that the thickness of the rest of molding portion 14, including front face 14*c* and toe 14*f*, may be any thickness as desired including thicker than the thickness of notch 18 (FIGS. 11 and 12).

Figure 11:
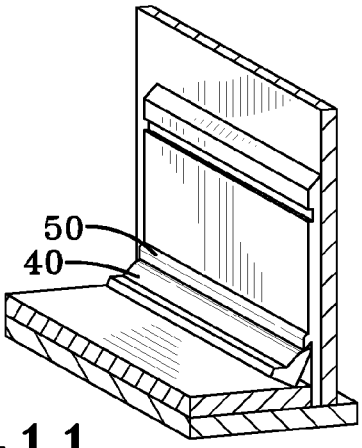
FIGS. 11 and 12 are perspective views of another embodiment of the two-part molding system according to the present invention, as shown in FIG. 5A.
Figure 12:
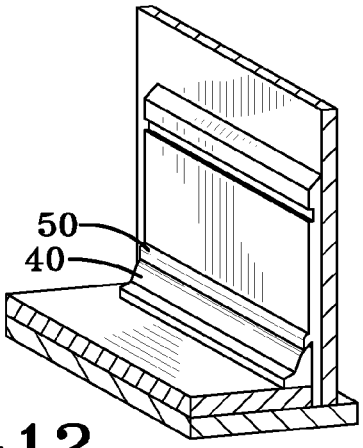
Figure 13:
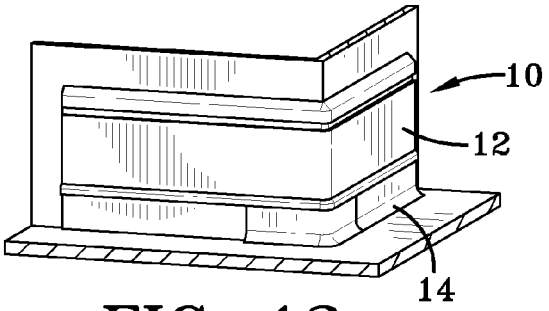
FIGS. 13-18 are perspective views of one embodiment of the two-part molding system according to the present invention, as shown in FIG. 5A and as applied around inside corners or outside corners of walls.
Figure 14:
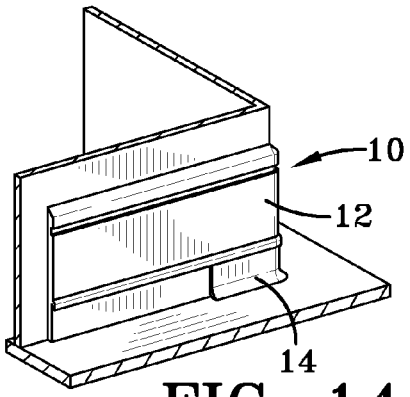
Figure 15:
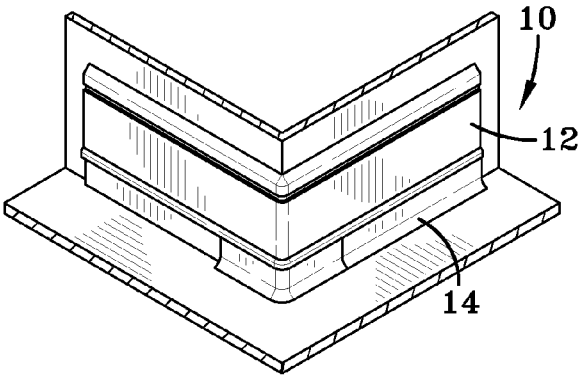
Figure 16:
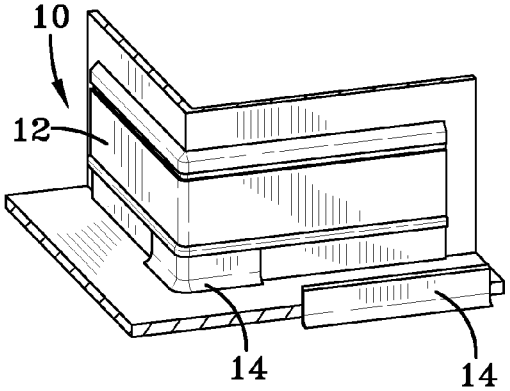
Figure 17:
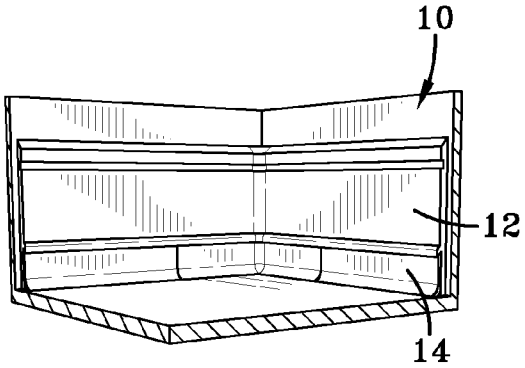
Figure 18:
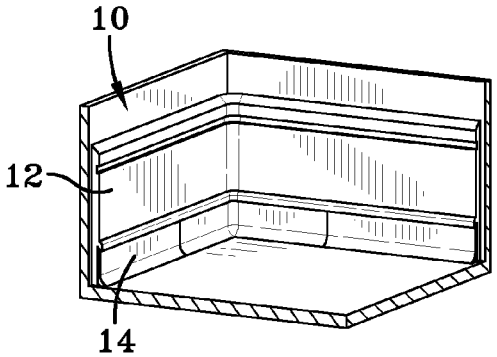

Referring to FIGS. 11 and 12, an alternative embodiment of the two-part molding system is shown and described. The primary features of the two-part molding system 10 shown and described in FIG. 5A are maintained in the embodiment set forth in FIGS. 11 and 12. However, in an alternative embodiment molding portion 40 (FIGS. 11 and 12) can comprise a height approximately about 0-25% greater than the height of notch 50 (FIGS. 11 and 12) as measured from female receiving end 18*c* to the floor F, and preferably approximately about 0-10% greater than the height of notch 50 (FIGS. 11 and 12) as measured from female receiving end 18*c* to the floor F.

As will be understood, it is advantageous that the engagement between mounting portion 14 and notch 18 at female receiving end 18*c* creates a strong compression engagement in a substantially downwardly manner ("X" in FIG. 5A) between molding portion 14 and the underlying floor F. In other words, the molding portion 14 is secured to mounting portion 12 at notch 18 in such a manner that molding portion 14 compresses downwardly onto the floor F at the juncture of toe 14*f* with the floor F. The downwardly compression mount affects the mounting portion 14 to be substantially flush with the floor F, thereby creating a seemingly seam-less or gap-less transition between the two-part molding system 10 and the floor F. The compression juncture between molding portion 14 and the floor F also affects a tight seal with the floor and accommodates any slight changes in the floor height. This in turn facilitates the prevention of as much undesirable dirt, moisture, debris, or any other elements as possible from entering gaps and accumulating behind the two-part molding system 10.

As can be readily seen in FIG. 5A, the configuration of the engagement of molding portion 14 against notch 18 can, in an embodiment, create a gap or space 22 between rear curved surface 14*e* and mounting portion 12. This gap or space 22 extends the length of the installed two-part molding system 10. To this end, gap or space 22 can be optionally filled with a filling material such as but not limited to beaded caulk, silicone, foam, anti-microbial beaded caulk, anti-microbial silicone, anti-microbial foam, anti-bacterial beaded caulk, anti-bacterial silicone, anti-bacterial foam, or any other comparable filling material(s) conventional in the art.

As set forth above, the molding portion 14 may be removable from mounting portion 12 as desired with minimal effort and without damage to the permanently or semi-permanently mounted mounting portion 12. This advantageously reduces the time and expense in maintaining, replacing or repairing the two-part molding system 10 as a whole due to damage or desired aesthetic changes. At the same time, the permanently or semi-permanently mounted mounting portion 12, such as a relatively more expensive wall base, may remain in place and need not be replaced thereby further reducing time and expense in the maintenance, replacement or repair of the overall two-part molding system 10.

It should be appreciated that the mounting portion 12 may comprise any particular dimensions as required by the particular application depending on aesthetics, required durability, construction standards such as LEED standards, etc. For example an alternative example, mounting portion 12 as a wall base may have a height of at least 4 inches. For example, in a sanitary environment such as a hospital or nursing home, mounting portion 12 as a wall base may have a height of at least 6 inches.

Referring to FIGS. 13-18, it should also be appreciated that two-part molding system 10 may advantageously be installed around inside corners and outside corners of walls while maintaining the appropriate downward compression engagement between the molding portion and the underlying floor creating a substantially flush engagement between the molding and the floor.

Figure 19:
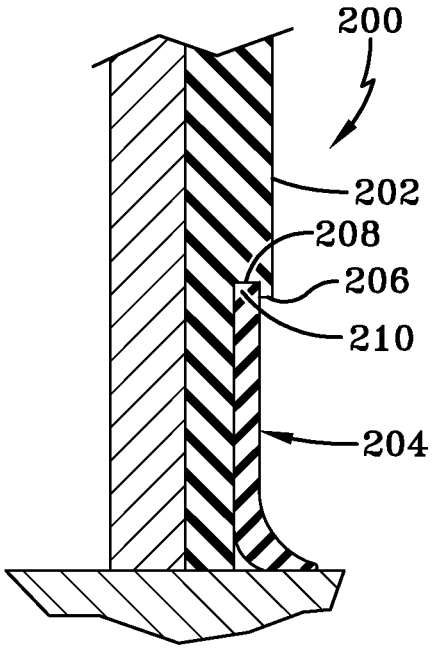
FIG. 19 is a cross-sectional view of an alternative embodiment of the two-part molding system according to the present invention.

Referring to FIG. 19, yet another alternative embodiment of the two-part molding system of the present invention is shown and described at 200. The embodiment shown in FIG. 19 generally comprises the same structural features as described in detail above, including a mounting portion 202, a molding portion 204 and an overhanging projection or abutment 206 for defining a groove or recess 208. In the embodiment of FIG. 19, projection or abutment 206 is a substantially downwardly extending projection or abutment. In other words, the outer surface of the projection or abutment 206 may be substantially planar with the outer surface of mounting portion 202. As shown in FIG. 19, groove or recess 208 comprises a substantially squared or flat configuration such that the innermost portion of groove or recess 208 meets the adjacent surface of the mounting portion 202 at a substantially 90° right angle. In this case, molding portion 204 comprises a top surface 210 having a substantially corresponding flat or squared configuration, as depicted in FIG. 19. It should be appreciated that in accordance with the present invention, the downwardly extending projection or abutment 206 may be omitted in which case groove or recess 208 would be a planar abutment surface, such as a ledge, being substantially perpendicular to the vertical surface of the mounting portion 202. As depicted in FIG. 19, the downwardly extending projection or abutment 206 is shown as substantially flat but can of course be angled or rounded, or comprise any other downwardly extending configuration as desired.

Figure 20:
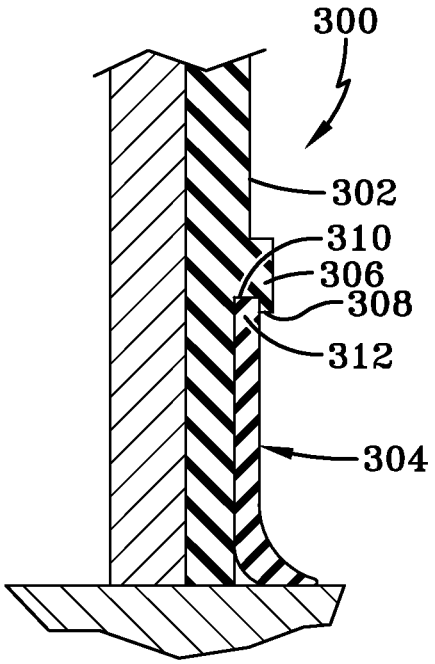
FIG. 20 is cross-sectional view of another alternative embodiment of the two-part molding system according to the present invention.
Figure 21:
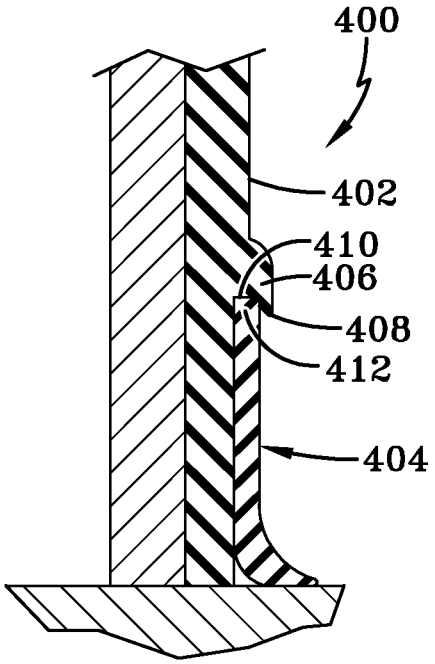
FIG. 21 is a cross-sectional view of another alternative embodiment of the two-part molding system according to the present invention.
Figure 22:
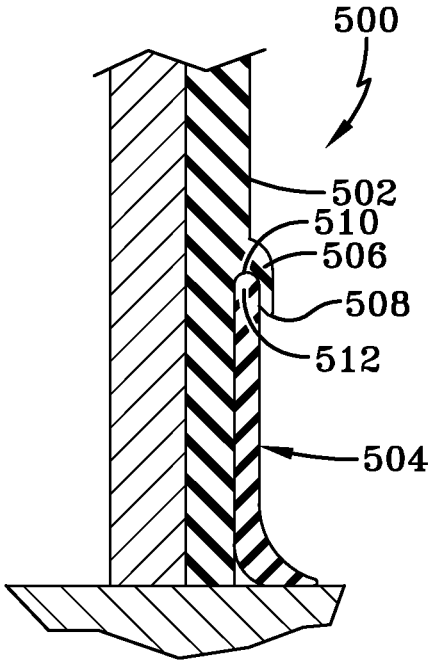
FIG. 22 is a cross-sectional view of another alternative embodiment of the two-part molding system according to the present invention.

Referring to FIG. 20, yet another alternative embodiment of the two-part molding system of the present invention is shown and described at 300. The embodiment shown in FIG. 20 generally comprises the same structural features as described in detail above, including a mounting portion 302, a molding portion 304 and an overhanging projection or abutment 306 having a substantially downwardly extending tip 308 for defining a groove or recess 310. As discussed above, it should be appreciated that in accordance with the present invention, the downwardly extending tip 308 may be omitted in which case groove or recess 310 would be a planar abutment surface, such as a ledge, being substantially perpendicular to the vertical surface of the mounting portion 302. In the embodiment of FIG. 20, projection or abutment 306 is a substantially outwardly extending projection or abutment comprising a substantially squared cross-sectional outer surface configuration, but of course it should be appreciated that the outer surface configuration can be any such configuration as desired including curved. As shown in FIG. 20, groove or recess 310 also comprises a substantially squared or flat configuration such that the innermost portion of groove or recess 310 meets the adjacent surface of the mounting portion 302 at a substantially 90° right angle. In this case, molding portion 304 comprises a top surface 312 having a substantially corresponding flat or squared configuration, as depicted in FIG. 20. As depicted in FIG. 20, the downwardly extending tip 308 is shown as substantially flat but can of course be angled or rounded, or comprise any other downwardly extending configuration as desired Referring to FIG. 21, yet another alternative embodiment of the two-part molding system of the present invention is shown and described at 400. The embodiment shown in FIG. 21 generally comprises the same structural features as described in detail above, including a mounting portion 402, a molding portion 404 and a projection or abutment 406 having a substantially downwardly extending tip 408 for defining a groove or recess 410. In the embodiment of FIG. 21, projection or abutment 406 is a substantially outwardly extending projection or abutment comprising a substantially contoured or curved cross-sectional outer surface configuration, but of course it should be appreciated that the outer surface configuration can be any such configuration as desired including squared. As shown in FIG. 21, groove or recess 410 also comprises a substantially squared or flat configuration such that the innermost portion of groove or recess 410 meets the adjacent surface of the mounting portion 402 at a substantially 90° right angle. In this case, molding portion 404 comprises a top surface 412 having a substantially corresponding flat or squared configuration, as depicted in FIG. 21. As depicted in FIG. 21, the downwardly extending tip 408 is shown as substantially angled but can of course be flat or rounded, or comprise any other downwardly extending configuration as desired Referring to FIG. 22, yet another alternative embodiment of the two-part molding system of the present invention is shown and described at 500. The embodiment shown in FIG. 22 generally comprises the same structural features as described in detail above, including a mounting portion 502, a molding portion 504 and a projection or abutment 506 having a substantially downwardly extending tip 508 for defining a groove or recess 510. In the embodiment of FIG. 22, projection or abutment 506 is a substantially outwardly extending projection or abutment comprising a substantially contoured or curved cross-sectional outer surface configuration, but of course it should be appreciated that the outer surface configuration can be any such configuration as desired including squared. As shown in FIG. 22, groove or recess 510 also comprises a substantially inwardly curved or rounded configuration. In this case, molding portion 504 comprises a top surface 512 having a substantially corresponding outwardly curved or rounded configuration, as depicted in FIG. 21. As depicted in FIG. 22, the downwardly extending tip 508 is shown as substantially angled, but can of course be flat or rounded, or comprise any other downwardly extending configuration as desired Application Steps of the Present Invention The installation steps of the present invention will now be described in a concise step by step discussion. As stated above, the installation of the two-part molding system according to the present invention is relatively simple and should be understood by those skilled in the art using conventional installation methods for conventional mounting portions, such as a wall base. In accordance with the present invention, the installation steps facilitate the cost- and time-effectiveness for the installation of the two-part molding system of the present invention, as well as to accommodate the use of a molding portion having uniform size throughout the desired installation regardless of the thickness of the particular flooring in place. In other words, by way of the present invention, molding portions of variable sizes in a single installation can be avoided as much as possible thereby reducing overall time and expense. The expense for replacement and/or repair is also reduced by way of the present invention having a uniform size molding portion. As explained in greater details below, the installation steps include (1) installation of the desired flooring, (2) installation of the desired mounting portion on top of the installed flooring, and (3) installation (insertion) of the desired molding portion. Of course, it should be appreciated that molding portions having variable sizes and/or heights are still envisioned and may be employed in accordance with the present invention.

Step 1—The desired flooring is installed, which can be any type of flooring including rubber flooring, vinyl flooring, wood, ceramic tiles, porcelain tiles, glazed tiles, and quarry tiles by conventional methods.

Step 2—The mounting portion is installed against the wall at the base of the wall by methods conventional in the art, such as by conventional adhesive agents. It should be understood that the mounting portion is installed after to the installation of the desired flooring, which can be any type of flooring including rubber flooring, vinyl flooring, ceramic tiles, porcelain tiles, glazed tiles, and quarry tiles. Of course, it should be appreciated that the mounting portion could be installed prior to the installation of the desired flooring.

Step 3—Once the mounting portion has sufficiently set, such as after about 1 day, the molding portion is set in place along the mounting portion, e.g., wall base. The molding portion can be manually installed by placing the top surface of the molding portion into and against the underside of the notch such that the top surface meets with the corresponding portion of the receiving end of the notch. The base of the molding portion is manually set in place against the bottom of the mounting portion. The downward compression created by the secure fit between the mounting portion and the molding portion in combination with the compression joining of the molding portion with the floor sufficiently keeps the molding portion in place and creates a seam-less or gap-less juncture between the molding system and the floor.

Optionally, any conventional adhesive, adhesive tape, glue, caulk, anti-microbial caulk, anti-bacterial caulk and the like as employed in the art is applied to the backside of the molding portion prior to installation against mounting portion to facilitate the fit between the molding portion and the mounting portion.

Optionally, a sealing agent, such as an anti-microbial caulk or anti-bacterial caulk, is set in the space between the molding portion and the mounting portion to further enhance the sanitary environment and to further strengthen the fit between the molding portion and the mounting portion.

The invention has been described with particular emphasis on the preferred embodiments. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention or the equivalents thereof.

I claim:

1. A two-part molding system for use in connection with an underlying floor and a wall adjacent to the underlying floor, said two-part molding system comprising:

a mounting portion having a back surface, a front surface, a top side and a bottom side, said mounting portion comprising:

an abutment on said mounting portion front surface defining an engaging area on the underside of said abutment; and a molding portion having a back surface, a front surface, a top side, and a bottom side, wherein said molding portion top side defines an engaging surface for engagement with said engaging area of said abutment, and wherein said molding portion bottom side defines a toe portion, said toe portion extending outwardly relative to said front surface of said mounting portion for engaging the underlying floor;

wherein said molding portion creates a compression engagement between said mounting portion and the underlying floor in response to the placement of said molding portion top side in engagement with said engaging area of said abutment and the engagement of said toe portion with the underlying floor, and wherein said molding portion back surface forms a continuous engagement with said mounting portion front surface in response to the compression engagement of said molding portion.

2. The two-part molding system according to claim 1, wherein said abutment is selected from the group consisting of a notch, a flange, and a lip.

3. The two-part molding system according to claim 1, wherein said engaging area is selected from the group consisting of a groove, a recess, and an abutment surface.

4. The two-part molding system according to claim 1, wherein said toe portion comprises respective front and rear curved surfaces extending outwardly relative to said mounting portion front surface, and wherein said toe portion tapers in thickness from said respective curved surfaces to the toe portion engaging the underlying floor.

5. The two-part molding system according to claim 4, wherein said rear curved surface defines a space between said molding portion and said front surface of said mounting portion.

6. The two-part molding system according to claim 5, wherein said space is of sufficient size to accommodate at least one of an adhesion material and a filling material selected from the group consisting of caulks, beaded caulks, foams and silicone.

7. The two-part molding system according to claim 1, wherein said mounting portion is selected from the group consisting of wall bases, trim, and molding.

8. The two-part molding system according to claim 7, wherein said mounting portion comprises a material selected from the group consisting of flexible plastic, thermoplastic, vinyl, PVC, rubber, wood, and faux wood.

9. The two-part molding system according to claim 1, wherein said molding portion is selected from the group consisting of trim, molding, and flooring toe.

10. The two-part molding system according to claim 9, wherein said molding portion comprises a material selected from the group consisting of flexible plastic, thermoplastic, vinyl, PVC, rubber, wood, and faux wood.

11. The two-part molding system according to claim 1, wherein said molding portion top side defines a surface for engagement with said engaging area of the underside of said abutment and is selected from the group consisting of a male portion and a female portion, and wherein said underside of said abutment for defining an engaging area is selected from the group consisting of a male portion and a female portion for engaging with said molding portion top side in a corresponding and complementing manner.

12. The two-part molding system according to claim 11, wherein said molding portion top side defines a surface selected from the group consisting of an outwardly angled surface, an inwardly angled surface, an outwardly curved or rounded surface, an inwardly curved or rounded surface, a flat surface and a triangular surface, and wherein said underside of said abutment for defining an engaging area defines a surface selected from the group consisting of an outwardly angled surface, an inwardly angled surface, an outwardly curved or rounded surface, an inwardly curved or rounded surface, a flat surface and a triangular surface, wherein said respective surfaces are substantially corresponding and complementing with the other.

13. The two-part molding system according to claim 11, wherein said molding portion top side defines an inwardly angled surface or an outwardly angled surface, wherein said outwardly angled surface or said inwardly angled surface comprises a surface angled in the range between 0°-90° and wherein the underside of said abutment for defining an engaging area is an outwardly angled surface or an inwardly angled surface and comprises a surface angled in the range between 0°-90°.

14. The two-part molding system according to claim 13, wherein said molding portion top side for defining an outwardly angled surface or an inwardly angled surface comprises a surface angled in the range between 30°-60° and wherein the underside of said abutment for defining an engaging area is an outwardly angled surface or an inwardly angled surface comprises a surface angled in the range between 30°-60°.

15. The two-part molding system according to claim 14, wherein said molding portion top side for defining an outwardly angled surface or an inwardly angled surface comprises a surface angled in the range between 40°-50° and wherein the underside of said abutment for defining an engaging area is an outwardly angled surface or an inwardly angled surface comprises a surface angled in the range between 40°-50°.

16. The two-part molding system according to claim 15, wherein said molding portion top side for defining an outwardly angled surface or an inwardly angled surface comprises a surface angled at about 45° and wherein the underside of said abutment for defining an engaging area is an outwardly angled surface or an inwardly angled surface comprises a surface angled at about 45°.

17. The two-part molding system according to claim 1, wherein said molding portion top side and the underside of said abutment are surfaces of substantially corresponding sizes and configurations for engagement with the other.

18. The two-part molding system according to claim 1, wherein the height of the molding portion is effectively longer than the corresponding portion between the underside of said abutment and the underlying floor for affecting a compression engagement in a substantially downwardly manner and thereby affecting a flush engagement with the underlying floor.

19. The two-part molding system according to claim 18, wherein the height of said abutment from the underlying floor is about 1-3 inches above the underlying floor as measured from the juncture of said abutment with said mounting portion, and wherein said molding portion comprises an overall height being at least 0-25% greater than the height of said abutment for affecting a compression engagement in a substantially downwardly manner and thereby affecting a flush engagement with the underlying floor.

20. The two-part molding system according to claim 18, wherein the height of said abutment from the underlying floor is about 1-3 inches above the underlying floor as measured from the juncture of said abutment with said mounting portion, and wherein said molding portion comprises an overall height being at least 0-10% greater than the height of said abutment for affecting a compression engagement in a substantially downwardly manner and thereby affecting a flush engagement with the underlying floor.

21. The two-part molding system according to claim 1, further comprising at least one material selected from the group consisting of an adhesive, adhesive tape, glue, caulk, anti-microbial caulk and anti-bacterial caulk applied to the backside of the molding portion for enabling the continuous engagement of said molding portion back surface with said mounting portion front surface in response to the compression engagement of said molding portion.

22. A two-part molding system for use in connection with an underlying floor and a wall adjacent to the underlying floor, said two-part molding system comprising:

a mounting portion having a back surface, a front surface, a top side and a bottom side, said mounting portion comprising:

an abutment on said mounting portion front surface defining an engaging area, wherein said engaging area is configured as an angled surface extending outwardly, away from the mounting portion back surface, and downwardly, toward the mounting portion bottom side; and a molding portion having a back surface, a front surface, a top side, and a bottom side, wherein said molding portion bottom side defines a toe portion for engaging the underlying floor, and wherein said molding portion top side defines an engaging surface, said engaging surface being configured as a corresponding and complementing angled surface for engagement with said engaging area of said abutment;

wherein said molding portion creates a compression engagement between said mounting portion and the underlying floor in response to the engagement of said respective mounting portion and molding portion angled surfaces, and the engagement of said toe portion with the underlying floor, and wherein the compression engagement of said molding portion effects said molding portion back surface to engage with said mounting portion front surface for supporting said mounting portion and for maintaining the position of said molding portion relative to said mounting portion.

23. The two-part molding system according to claim 22, wherein said angled surface of said top side of said molding portion comprises and a flat tip at the upper end of said angled surface for providing clearance between said engaging area of said abutment and said flat tip for enabling a flush engagement of said respective mounting portion and molding portion angled surfaces.

24. A two-part molding system for use in connection with an underlying floor and a wall adjacent to the underlying floor, said two-part molding system comprising:

a mounting portion having a back surface, a front surface, a top side and a bottom side, said mounting portion comprising:

an abutment on said front surface of said mounting portion, wherein said mounting portion front surface underlying said abutment is configured as a planar surface, and wherein said abutment defines an engaging area, said engaging area being configured as an angled surface extending outwardly away from said mounting portion back surface and downwardly toward said mounting portion bottom side; and a molding portion having a back surface, a front surface, a top side, and a bottom side, wherein said molding portion back surface is configured as a planar surface for enabling a flush engagement with said planar front surface of said mounting portion, wherein said molding portion bottom side defines a toe portion, said toe portion comprising respective front and rear curved surfaces extending outwardly relative to said mounting portion front surface, wherein said toe portion tapers in thickness from said respective curved surfaces to the toe portion engaging the underlying floor, wherein said molding portion top side defines an engaging surface, said engaging surface being configured as a corresponding and complementing angled surface for engagement with said engaging area of said abutment, wherein said molding portion top side comprises a flat tip at the upper end of said angled surface for providing clearance between said flat tip and said mounting portion engaging area, and for enabling a flush engagement of said respective mounting portion and molding portion angled surfaces;

wherein said molding portion creates a compression engagement between said mounting portion and the underlying floor in response to the engagement of said respective mounting portion and molding portion angled surfaces, and the engagement of said toe portion with the underlying floor, and wherein said compression engagement of said mounting portion effects said planar back surface of said molding portion to form a continuous engagement with said planar front surface of said mounting portion for supporting said mounting portion and for maintaining the position of said molding portion relative to said mounting portion.

* * * * *